US008867979B2

(12) United States Patent
Fujita et al.

(10) Patent No.: US 8,867,979 B2
(45) Date of Patent: Oct. 21, 2014

(54) IMAGE FORMING METHOD AND IMAGE FORMING APPARATUS

(75) Inventors: Michiyo Fujita, Tokyo (JP); Tatsuya Nagase, Tokyo (JP); Asao Matsushima, Tokyo (JP); Yasuko Uchino, Tokyo (JP); Aya Shirai, Tokyo (JP); Ryuichi Hiramoto, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 120 days.

(21) Appl. No.: 13/339,432

(22) Filed: Dec. 29, 2011

(65) Prior Publication Data

US 2012/0177427 A1 Jul. 12, 2012

(30) Foreign Application Priority Data

Jan. 12, 2011 (JP) ..... 2011-003648

(51) Int. Cl.
*G03G 15/20* (2006.01)
*G03G 15/00* (2006.01)

(52) U.S. Cl.
CPC .... *G03G 15/6585* (2013.01); *G03G 2215/0081* (2013.01)
USPC ..... 399/341; 399/342

(58) Field of Classification Search
CPC ..... G03G 2215/00805; G03G 2215/0081; G03G 2215/00801; G03G 15/6582; G03G 15/6585; G03G 8/00
USPC ..... 399/341, 342
See application file for complete search history.

(56) References Cited

U.S. PATENT DOCUMENTS

| | | | | |
|---|---|---|---|---|
| 5,583,660 | A * | 12/1996 | Rylander | 358/3.17 |
| 6,535,712 | B2 * | 3/2003 | Richards | 399/341 |
| 7,340,190 | B2 * | 3/2008 | Toyohara et al. | 399/45 |
| 7,890,034 | B2 * | 2/2011 | Murayama et al. | 399/299 |
| 7,952,752 | B2 * | 5/2011 | Shoji | 358/1.9 |
| 8,383,189 | B2 * | 2/2013 | Lang | 427/8 |
| 8,447,204 | B2 * | 5/2013 | Qiao et al. | 399/82 |

FOREIGN PATENT DOCUMENTS

| | | | | |
|---|---|---|---|---|
| JP | 05-232840 | | 9/1993 | |
| JP | 06-273994 | | 9/1994 | |
| JP | 11-007174 | | 1/1999 | |
| JP | 2007108585 | A * | 4/2007 | G03G 15/01 |

* cited by examiner

*Primary Examiner* — David Gray
*Assistant Examiner* — Carla Therrien
(74) *Attorney, Agent, or Firm* — Lucas & Mercanti, LLP

(57) ABSTRACT

Provided are an image forming method by which an image in which arbitrary glossiness is adjusted to any section is formed, and an image forming apparatus thereof. It is a feature that an image forming method possesses the steps of forming a gloss adjusting layer possessing a gloss adjusting toner-fixed image formed with a gloss adjusting toner, on an image support, and forming a toner-fixed image obtained from a toner, on the gloss adjusting layer, wherein the gloss adjusting layer possesses an aggregate of gloss adjusting units; the gloss adjusting units each possess a section where the gloss adjusting toner is attached and another section where the gloss adjusting toner is unattached; and a borderline between the section and the another section is a straight line.

7 Claims, 3 Drawing Sheets

IMAGE FORMING METHOD AND IMAGE FORMING APPARATUS

This application claims priority from Japanese Patent Application No. 2011-003648 filed on Jan. 12, 2011, which is incorporated hereinto by reference.

TECHNICAL FIELD

The present invention relates to an image forming method and an image forming apparatus.

BACKGROUND

In recent years, in order to improve an added value in the field of printing such as catalog printing, direct mail printing and so forth, there has been an increasing demand for high value-added prints having been subjected to a surface treatment such as a gloss treatment, for example. As to a such a print, one capable of adjusting the entire print surface or a part of it to a desired glossiness is demanded, and further, one capable of controlling the glossiness finely is also demanded.

In Patent Document 1, proposed is a method employing a toner containing no colorant component, called a dear toner or a transparent toner, for example, as a technique of forming the uniform gloss surface for the entire print surface. Specifically, it is a method of forming the gloss surface exhibiting glossiness evenly on the entire print surface by providing a toner, or the clear toner on an image formed via ink-jet in the form of a layer, followed by heating and cooling.

However, in the case of the method proposed in Patent Document 1, an image for which glossiness of the entire print surface is improved can be formed, but it appears that it is difficult to form an image for which an arbitrary section is adjusted to any glossiness.

Patent Document 1: Japanese Patent O.P.I. (Open to Public Inspection) Publication No. 11-7174.

SUMMARY

The present invention was made on the basis of the above-described situation, and it is an object of the present invention to provide an image forming method capable of forming an image for which an arbitrary section is adjusted to any glossiness as well as an image exhibiting no feeling of difference in glossiness when observing the image at a different angle, and to provide an image forming apparatus thereof.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which:

FIGS. 1*a* and 1*b* each show a schematic diagram to explain an image forming method of the present invention, wherein FIG. 1*a* is a diagram showing a state where a gloss adjusting layer is formed on an image support, and FIG. 1*b* is a diagram showing a state where a toner-fixed image is formed on the gloss adjusting layer;

DESCRIPTION OF THE PREFERRED EMBODIMENTS

Figure 1A:
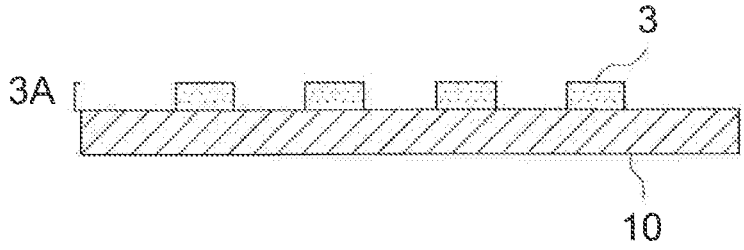

It is a feature in an image forming method of the present invention that an image forming method comprising the steps of forming a gloss adjusting layer comprising a gloss adjusting toner-fixed image formed with a gloss adjusting toner, on an image support, and forming a toner-fixed image obtained from a toner, on the gloss adjusting layer, wherein the gloss adjusting layer comprises an aggregate of gloss adjusting units; the gloss adjusting units each comprise a section where the gloss adjusting toner is attached and another section where the gloss adjusting toner is unattached; and a borderline between the section and the another section comprises a straight line.

As to an image forming method of the present invention, the gloss adjusting layer preferably comprises a clear toner.

As to an image forming method of the present invention, the gloss adjusting layer preferably has a thickness of 3-20 μm.

As to an image forming method of the present invention, the gloss adjusting toner preferably comprises a particle having a particle diameter of 5-15 μm.

As to an image forming method of the present invention, the gloss adjusting units each as a whole are preferably in the form of a square, the square, 100-500 μm on a side.

As to an image forming method of the present invention, it is preferable that the gloss adjusting units in the form of a square each are composed of four squares formed by longitudinally and transversely dividing a region in the form of a square as the each in two equal parts, and the each is in the form of a checkered pattern in which two of the four squares are gloss adjusting toner-attached sections, provided that the gloss adjusting toner-attached sections are not placed longitudinally and transversely.

It is a feature that an image forming apparatus of the present invention comprises a device of forming a gloss adjusting toner image by which an electrostatic latent image formed on an electrostatic latent image carrier is developed with a developer in which a gloss adjusting toner is contained to form the gloss adjusting toner image, and a device of forming a gloss adjusting toner-fixed image by which the gloss adjusting toner image is transferred onto an image support; and fixed to form the gloss adjusting toner-fixed image, wherein the gloss adjusting toner-fixed image formed by the device of forming the gloss adjusting toner-fixed image comprises a gloss adjusting layer formed from an aggregate of gloss adjusting units; the gloss adjusting units each comprise a gloss adjusting toner-attached section and a gloss adjusting toner-unattached section; and a borderline between the gloss adjusting toner-attached section and the gloss adjusting toner-unattached section is a straight line.

The image forming apparatus of the present invention preferably comprises a device of forming a toner image by which an electrostatic latent image formed on an electrostatic latent image carrier is developed with a developer in which a toner is contained, and a device of funning a toner-fixed image by which the toner image is transferred onto the gloss adjusting toner-fixed image, and fixed to form the toner-fixed image.

While the preferred embodiment of the present invention have been described using specific terms, such description is for illustrative purposes only, and it is to be understood that changes and variations may be made without departing from the spirit or scope of the appended claims.

DETAILED DESCRIPTION OF THE INVENTION

Next, the present invention will be described in detail.

[Image Forming Method]

The image forming method is a method to obtain an image in which glossiness is adjusted (hereinafter, referred to also as "gloss adjusting image") via the steps of forming a gloss adjusting layer comprising a gloss adjusting toner-fixed image formed from a gloss adjusting toner, on an image support, and forming a toner-fixed image obtained from a toner, on the gloss adjusting layer. Accordingly, the entire image to be formed or a part of it can be controlled so as to obtain a desired glossiness via an image forming method of the present invention.

An image forming method of the present invention may be implemented employing an image forming apparatus with which a step of forming a gloss adjusting layer and a step of forming a toner-fixed image are continuously conducted, and the step of forming a gloss adjusting layer and the step of forming a toner-fixed image may be also conducted with an image forming apparatus and another image forming apparatus, respectively.

[Step of Forming Gloss Adjusting Layer]

In the step of forming a gloss adjusting layer, as a method of forming a gloss adjusting layer, utilized can be an electrophotographic image forming method. For example, as shown in FIG. 1*a*, a gloss adjusting toner image formed by developing an electrostatic latent image having been formed on an electrostatic latent image carrier with gloss adjusting toner is transferred onto image support 10, and gloss adjusting toner-fixed image 3 is formed by heat-applied pressure-fixing the gloss adjusting toner image having been transferred to form gloss adjusting layer 3A via the foregoing. The gloss adjusting toner is not specifically limited, as long as it has no effect on hue of toner-fixed image 2 formed on gloss adjusting layer 3A, but toner or the like in the same color as those of clear toner and image support 10, for example, is usable.

[Step of Forming Toner-Fixed Image]

Figure 1B:
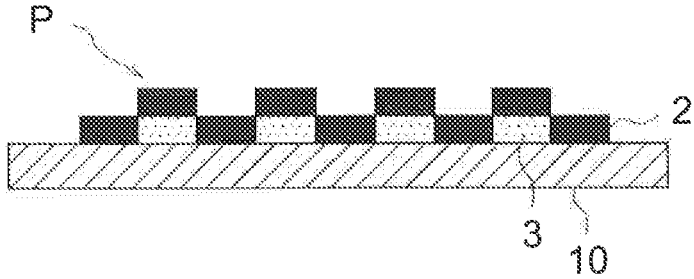

In the step of forming a toner-fixed image, an electrophotographic image forming method can be utilized as a method of forming a toner-fixed image. For example, as shown in FIG. 1*b*, a toner image formed by developing an electrostatic latent image having been formed on an electrostatic latent image carrier with toner is transferred onto gloss adjusting layer 3A, and toner-fixed image 2 is formed by heat-applied pressure-fixing the toner image having been transferred.

Toner-fixed image 2 formed in the step of forming a toner-fixed image may be formed from chromatic toners as plural color toners such as yellow toner, magenta toner, cyan toner, black toner and so forth, for example, and may be also formed from a chromatic toner as a single color toner. Further, it may be also formed from a colorless toner.

In an image forming method of the present invention, gloss adjusting image P in which toner-fixed image 2 is formed on gloss adjusting layer 3A is obtained by conducting the step of forming a toner-fixed image after conducting the step of forming a gloss adjusting layer. As to the surface of the resulting gloss adjusting image P, a ratio between diffuse reflection light and specular reflection light on the surface of gloss adjusting image P is varied depending on the concavo-convex degree produced by presence or absence of gloss adjusting toner-attached sections constituting gloss adjusting layer 3A, whereby glossiness is also varied. Accordingly, when the concavo-convex degree produced by presence or absence of gloss adjusting toner-attached sections constituting gloss adjusting layer 3A, that is, the kind, size, a placing method thereof or the like of the after-mentioned gloss adjusting unit is appropriately adjusted, glossiness is to be adjusted, whereby gloss adjusting image P in which arbitrary section is adjusted to any glossiness can be obtained.

Further, since as to an image forming method of the present invention, toner-fixed image 2 is formed on the outermost surface by conducting the step of forming a toner-fixed image after conducting the step of forming a gloss adjusting layer, hue and texture possessed by toner-fixed image 2 are to be maintained as they are now, and gloss adjusting image P exhibiting neither sense of white turbidity nor unpleasant sensation can be formed while adjusting arbitrary sections to any glossiness.

In the step of forming a gloss adjusting layer, gloss adjusting layer 3A to be formed is formed from an aggregate of gloss adjusting units, that is an aggregate where the gloss adjusting units are repeated, and planarly placed, and the gloss adjusting units each are composed of one in which a borderline between the gloss adjusting toner-attached section and the gloss adjusting toner-unattached section is a straight line. When as to gloss adjusting layer 3A, one in selected kind or size is used as the gloss adjusting unit, the gloss adjusting layer has a function to adjust glossiness, and an arbitrary section in gloss adjusting image P can be adjusted to any glossiness.

As to the layer thickness of gloss adjusting layer 3A, specifically, the gloss adjusting toner-attached section preferably has a thickness of 3-20 μm, and more preferably has a thickness of 4-13 μm. When the layer thickness of gloss adjusting layer 3A falls within the above-described range, arbitrary sections can be surely adjusted to any glossiness. When the layer thickness of gloss adjusting layer 3A is too small, no excellent reproducibility for gloss adjusting layer 3A is produced since a gloss adjusting toner adhesion amount is insufficiently obtained, and in gloss adjusting image P, arbitrary sections tend not to be adjusted to any glossiness. On the other hand, when the layer thickness of gloss adjusting layer 3A is too large, the concavo-convex difference between presence and absence of adhesion of gloss adjusting toner becomes too large, and transfer failure tends to occur during formation of toner-fixed image 2 on gloss adjusting layer 3A.

[Gloss Adjusting Unit]

In the present invention, a gloss adjusting unit comprises a gloss adjusting toner-attached section and a gloss adjusting toner-unattached section, a borderline between the gloss adjusting toner-attached section and the gloss adjusting toner-unattached section is a straight line. Herein, what a borderline between the gloss adjusting toner-attached section and the gloss adjusting toner-unattached section is a straight line means that a writing state is in the form of a straight line, and a very small curve caused by a part of writing dots or toner shape is substantially regarded as a straight line. As an example of what a borderline between the gloss adjusting toner-attached section and the gloss adjusting toner-unattached section is a straight line, cited is one in which the gloss adjusting toner-attached section in a region as the gloss adjusting unit is in the form of a polygon having straight line sides. On the other hand, those in the form of a circle as described in Patent Documents such as Japanese Patent O.P.I. Publication No. 5-232850, Japanese Patent Publication No. 6-273994 and so forth are not included. In these Patent Documents, proposed is a method of providing glossiness via image surface processing with clear toner, but since clear toner-attached section is in the form of a circle, the resulting image exhibits insufficient fineness of the gloss adjusting layer, and often tends not to be adjusted to desired glossiness. When the gloss adjusting unit is circle-shaped, asperity of the gloss adjusting layer is reduced since the gloss adjusting unit tends to be expanded during fixing, and controlling of glossiness is to be lowered. Further, since it is difficult to control the gloss adjusting unit in size when circularly writing, the gloss adjusting unit may be formed from straight lines.

The kind and size of the gloss adjusting unit are appropriately selected depending on glossiness to be adjusted, but the gloss unit as a whole is preferably in the form of a regular polygon, and is more preferably in the form of a square.

A gloss adjusting unit in the form of a square is preferably the square, 100-500 μm on a side. The area of any section for an original image to adjust arbitrary glossiness is set to be constant. In cases where gloss adjusting units are densely placed longitudinally and transversely, the longer the side of the gloss adjusting unit, the higher the glossiness is, and the shorter the side of the gloss adjusting unit, the lower the glossiness is. In this case, concave-convex portions caused by presence or absence of attached gloss adjusting toner in the resulting gloss adjusting image P are also reduced when the length of one side of a gloss adjusting knit becomes longer, that is, the number of repeating gloss adjusting units is small, a diffuse reflection light rate is reduced, and a specular reflection light rate is increased, resulting in increase of glossiness. On the other hand, concave-convex portions caused by presence or absence of attached gloss adjusting toner in the resulting gloss adjusting image P are also increased when the length of one side of a gloss adjusting unit becomes shorter, that is, the number of repeating gloss adjusting units is large, a diffuse reflection light rate is increased, and a specular reflection light rate is reduced, resulting in reduction of glossiness.

Figure 2A:
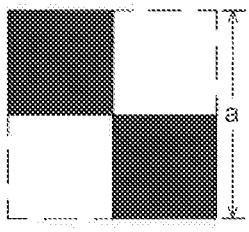
FIGS. 2*a*, 2*b*, 2*c* and 2*d* each are a diagram showing a specific example of a gloss adjusting unit used for an image forming method of the present invention.
Figure 2B:
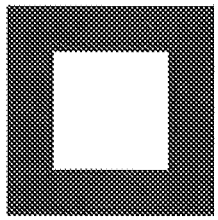
Figure 2C:
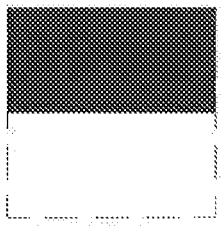
Figure 2D:
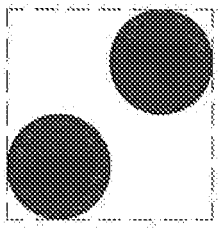

FIGS. 2*a*, 2*b* and 2*c* each show a specific example of a gloss adjusting unit in the form of a square. In FIGS. 2*a*, 2*b* and 2*c*, the black-smeared section shows a gloss adjusting toner-attached section, and the white patch section shows a gloss adjusting toner-unattached section. In FIG. 2*a*, a gloss adjusting unit is in the form of a checkered pattern in which two of four squares formed by dividing a region in the form of a square as the adjusting unit in two equal parts are formed as gloss adjusting toner-attached sections, provided that the gloss adjusting toner-attached sections are not placed longitudinally and transversely. In FIG. 2*b*, a gloss adjusting unit has a pattern in which a square frame-shaped section provided along four sides of a region in the form of a square is formed as a gloss adjusting toner-attached section. In FIG. 2*c*, a gloss adjusting unit has a pattern in which the upper one of two rectangles formed by transversely dividing a region in the form of a square as a gloss adjusting unit is formed as a gloss adjusting toner-attached section, and the lower one of the two rectangles is formed as a gloss adjusting toner-unattached section. Further, FIG. 2*d* shows a configuration in which two circular gloss adjusting toner-attached sections each having a one-half of a side of the gloss adjusting unit in length as a diameter of the circle are formed as shown in the figure.

As a gloss adjusting unit as a whole in the form of a square, the gloss adjusting unit shown in FIG. 2*a* is specifically preferable. It appears that fineness to adjust gloss depends on the total distance of a borderline between the gloss adjusting toner-attached section and the gloss adjusting toner-unattached section in a region as a gloss adjusting unit. Accordingly, it appears that the gloss adjusting unit shown in FIG. 2*a* can adjust gloss finely in comparison to, for example, the gloss adjusting unit shown in FIG. 2*b*, the gloss adjusting unit shown in FIG. 2*c* and so forth, since the total distance of the borderline between the gloss adjusting toner-attached section and the gloss adjusting toner-unattached section in a region as a gloss adjusting unit is long.

Figure 3A:
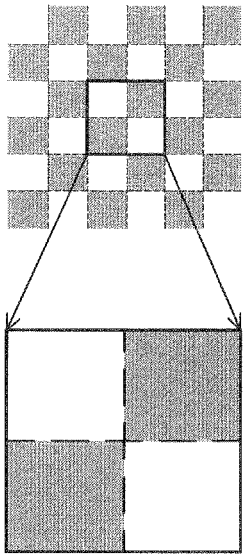
FIGS. 3*a*, 3*b*, 3*c* and 3*d* each are a diagram to explain the total distance of borderlines each between a gloss adjusting toner-attached section and a gloss adjusting toner-unattached section in a gloss adjusting unit used for an image forming method of the present invention.
Figure 3B:
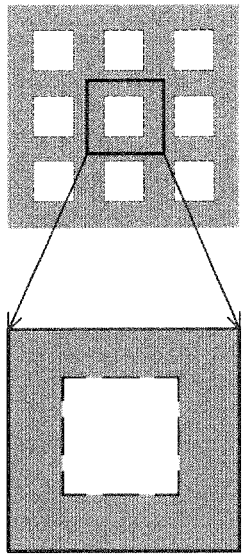
Figure 3C:
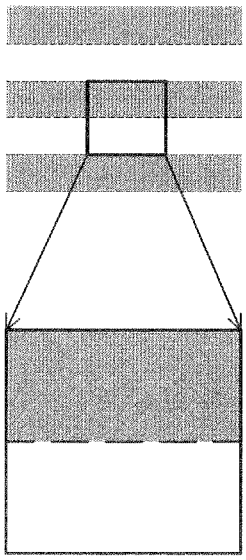
Figure 3D:
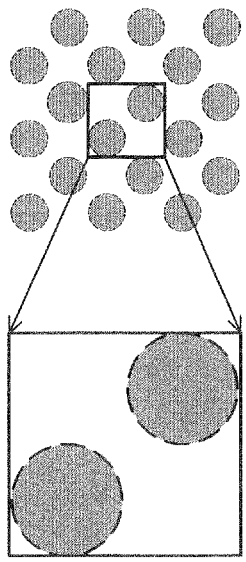

The total distance of the borderline between the gloss adjusting toner-attached section and the gloss adjusting toner-unattached section in a region as a gloss adjusting unit is preferably 100-400%, based on the perimeter of the entire shape of the gloss adjusting unit. In addition, the total distance of the borderline between the gloss adjusting toner-attached section and the gloss adjusting toner-unattached section in a region as a gloss adjusting unit means that the total distance of the borderline between the gloss adjusting toner-attached section and the gloss adjusting toner-unattached section per a gloss adjusting unit when gloss adjusting units are repeated so as to densely placing them longitudinally and transversely, including at least one borderline present between adjacent gloss adjusting units. Specifically, dashed lines in FIGS. 3*a*, 3*b* and 3*c* are borderlines each between the gloss adjusting toner-attached section and the gloss adjusting toner-unattached section. In FIG. 3*a*, when the perimeter of the entire shape of a gloss adjusting unit is A, the total distance of the borderlines becomes 200% with respect to A. Further, in FIG. 3*b*, when the perimeter of the entire shape of a gloss adjusting unit is A, the total distance of the borderlines becomes 100% with respect to A, and in FIG. 3*c*, when the perimeter of the entire shape of a gloss adjusting unit is A, the total distance of the borderlines becomes 100% with respect to A. Further, for reference, in FIG. 3*d*, the total distance of the borderlines becomes 157% with respect to A.

Glossiness in gloss adjusting layer 3A can be controlled by a method of placing each of gloss adjusting units. As the method of placing gloss adjusting units, for example, it may be a method by which each of gloss adjusting units is densely placed longitudinally and transversely, or a method by which gloss adjusting units each are placed in the predetermined intervals, but the method by which each of gloss adjusting units is densely placed longitudinally and transversely is preferable. Further, for example, when the gloss adjusting unit exhibits asymmetry of one above the other or right and left, it may also be a method by which each of gloss adjusting units is placed in accordance with a regular rule with respect to the direction of one above the other or right and left, or a method by which each of gloss adjusting units is placed at random. Further, for example, it may also be a method by which at least two gloss adjusting units used in combination are placed in accordance with a regular rule or at random.

Further, gloss adjusting layer 3A may be formed on the entire surface of image support 10, or may be formed locally on the surface of the image support.

[Gloss Adjusting Toner]

The gloss adjusting toner employed in the step of forming a glass adjusting layer is not specifically limited as long as it does not influence hue of toner-fixed image 2 formed on gloss adjusting layer 3A, but toner in the same color as that of a clear toner or an image support, and so forth are usable.

Gloss adjusting toner particles constituting the gloss adjusting toner preferably have a volume-based median diameter of 5-15 μm as the particle diameter, and preferably have a volume-based median diameter of 6-12 μm as the particle diameter. When the particle diameter of each of gloss adjusting toner particles is within the above-described range, gloss adjusting layer 3A formed from an aggregate obtained by repeating gloss adjusting units exhibits excellent reproducibility, and arbitrary section can be surely adjusted to any glossiness in gloss adjusting image P. When the particle diameter of each of the gloss adjusting toner particles is too small, no excellent developability is obtained, and a toner adhesion amount is insufficiently obtained, whereby gloss adjusting layer 3A formed from an aggregate obtained by repeating gloss adjusting units does not exhibit excellent reproducibility, and arbitrary section might not be adjusted to any glossiness. On the other hand, when the particle diameter of each of the gloss adjusting toner particles is too large, gloss adjusting layer 3A would not exhibit excellent reproducibility.

The volume-based median diameter of the gloss adjusting toner particles is measured and calculated by using "Coulter Counter Multisizer 3" manufactured by Beckman Coulter Co., Ltd. and a computer system fitted with a software for data processing "Software V3.51", manufactured by Beckman Coulter Co., Ltd. As measuring procedures, 0.02 g of a measuring sample (gloss adjusting toner) are wetted in 20 ml of a surfactant solution for dispersing the toner (for the purpose of dispersing the gloss adjusting toner, for example, a surfactant solution prepared by diluting a neutral detergent with pure water by 10 times), and subsequently subjected to ultrasonic dispersion for one minute to prepare a measuring sample dispersion. The measuring sample dispersion is injected into a beaker set on a sample stand, in which Isoton II, manufactured by Beckman Coulter Co., Ltd., is contained, until the concentration indicated by the measuring device reaches 5-10%. Measured values in high reproducibility can be obtained by falling within this concentration range. The frequency is calculated by separating the range of 2.0-60 μm into 256 divisions under the conditions of the count number of measuring particles of 25,000 and an aperture diameter of 100 μm with the measuring device, and the particle diameter at a point of 50% from the larger side of the volume accumulation ratio is specified as the volume-based median diameter.

Gloss adjusting toner particles constituting the gloss adjusting toner preferably have an average circularity of 0.900-0.980 in view of reproducibility of dots. When the average circularity of gloss adjusting toner particles falls within the above-described range, gloss adjusting layer 3A formed from an aggregate obtained by repeating adjusting units exhibits excellent reproducibility, and arbitrary section can be surely adjusted to any glossiness.

The average circularity of gloss adjusting toner particles is measured by "FPIA-2100" (manufactured by Sysmex Corp.). Specifically, a measuring sample (gloss adjusting toner) is wetted with an aqueous solution containing a surfactant, followed by conducting an ultrasonic dispersion treatment for one minute, and thereafter the dispersion of toner particles is photographed with "FPIA-2100" (manufactured by Sysmex Corp.) in an HPF (high magnification photographing) mode at an appropriate density of the HPF detection number of 3,000-10,000 as a measurement condition. The circularity of each toner particle is calculated in accordance with Equation (T) described below. Then, the average circularity is calculated by summing the circularities of each of particles and dividing the resulting value by the total number of particles.

Circularity=(circumference length of a circle having an area equivalent to a projection of a particle)/(circumference length of a projection of a particle) Equation (T):

Specifically, gloss adjusting toner used in the step of forming a gloss adjusting layer is preferably clear toner. The clear toner used in the step of forming a gloss adjusting layer will be described below in detail.

That is, the clear toner used in the step of forming a gloss adjusting layer is referred to as toner with which color is not visualized via action of light absorption or light scattering. That is, the clear toner may be substantially colorless and transparent, and specific examples thereof include toner containing no colorant such a pigment, a dye or the like, toner containing the foregoing colorant without exhibiting color-recognition, and toner exhibiting slightly low transparent caused by kinds and an addition amount of, for example, a binder resin, a releasing agent and external additives as components constituting the clear toner.

Clear toner particles each constituting clear toner specifically contain a binder resin exhibiting transparency (hereinafter, referred to also as "transparent resin") and may also contain a releasing agent, a charge control agent and so forth, if desired.

Examples of the transparent resin contained in clear toner particles include commonly known various thermoplastic resins such as vinyl based resins, for example, styrene based resins, (meth)acrylic resins, syrene(meth)acrylic copolymer resins, an olefin based resins and so forth; polyester based resins; polyimide based resins; polycarbonate resins; polyether, polyvinyl chloride based resins; polysulfone resins; polycarbonate resins and so forth; and thermosetting resins, for example, epoxy based resins. Specifically, in order to improve transparency, preferably provided are styrene based resins, acrylic resins and polyester based resins exhibiting high transparency together with a high sharp-melt property at low viscosity as to the melt property. These can be used singly or in combination with at least two kinds thereof.

As a releasing agent, contained in clear toner particles, commonly known wax is usable. Examples of the wax include polyolefin wax such as polyethylene wax, polypropylene wax and so forth; branched-chain hydrocarbon wax such as microcrystalline wax and so forth; long chain hydrocarbon wax such as paraffin wax, sazol wax and so forth; dialkyl ketone based wax such as distearyl ketone and so forth; ester based wax such as carnauba wax, montan wax, behenyl behenate, trimethylol propane tribehenate, pentaerithritol tetrabehenate, pentaerithritol diacetate dibehenate, glycerine tribehenate, 1,18-octadecane diol distearate, tristearyl trimellitate, distearyl maleate and so forth; and amide based wax such as ethylene diamine behenylamide, tristearylamide trimellitate and so forth.

The releasing agent preferably has a content of 1-15 parts by weight, based on 100 parts by weight of the binder resin, in terms of the fact that fixing separation and hue of an image support are not inhibited.

A charge control agent contained in clear toner particles is not specifically limited as long as it is a material capable of providing positive or negative charge via frictional electrification, and commonly known various positive charge control agents and negative charge control agents are usable, but those colorless and transparent are preferable.

The clear toner preferably has a softening point temperature of 85-140° C. in view of fixability of gloss adjusting layer 3A and reproducibility of dots.

The softening point of the clear toner is determined as described below. A measuring sample (clear toner) of 1.1 g is first placed in a Petri dish at a temperature of 20° C. and at a relative humidity of 50%, flattened out, and allowed to stand for at least 12 hours. Thereafter, a 1 cm diameter cylindrical molded sample is prepared via application of a pressure of 3,820 kg/cm$^2$, employing a molding machine "SSP-10A" (produced by Shimadzu Corp.). Subsequently, the resulting sample was measured under a temperature of 24° C. and a relative humidity of 50%, employing a flow tester "CFT-500D" (produced by Shimadzu Corp.). The resulting sample is extruded from a cylindrical die hole (1 mm diameter×1 mm) employing a 1 cm diameter piston after 300 second pre-heating under conditions of an applied load of 196 N (20 kgf), an initial temperature of 60° C., and a temperature raising rate of 6° C./minute, and offset method temperature $T_{offset}$ which is determined based on the fusion temperature determination method according to the temperature raising method, which is set at an offset value of 5 mm, is designated as the softening point of the clear toner.

Clear toner preferably has a glass transition point Tg of 35-70° C. in view of fixability of glass adjusting layer 3A and reproducibility of dots.

Glass transition point Tg of clear toner is measured with "Diamond DSC" manufactured by Perkin-Elmer Corp. In the measuring procedure, 3.0 mg of a measuring sample (clear toner) is enclosed in an aluminum pan, and then set onto a sample holder in a main body. Measurements for reference were performed employing an empty aluminum pan. Temperature control of Heat-Cool-Heat is carried out under the conditions of a measurement temperature of 0-200° C., a temperature-increasing speed of 10° C./min and a temperature-decreasing speed of 10° C./min, and analysis is made based on the data of the 2nd Heat. In addition, temperature was maintained at 200° C. for 5 minutes during temperature-increase of the first Heat. Glass transition point Tg is designated as the temperature at an intersection point of an extension line of a base line before rising of the first endoergic peak and the tangential line shown at the maximum inclination in the range between the rising part of the first endoergic peak and the peak thereof.

As methods of manufacturing the clear toner, provided are a kneading-pulverizing method, a suspension polymerization method, an emulsion polymerization method, an emulsion polymerization coagulation method, a mini-emulsion polymerization coagulation method, and an encapsulation method, and commonly known other methods, but a method of manufacturing the clear toner is preferably an emulsion polymerization coagulation method in view of production cost and manufacturing stability.

In the emulsion polymerization coagulation method, a dispersion of transparent resin particles contained in clear toner prepared in the emulsion polymerization method is optionally mixed with a dispersion of particles made of a releasing agent or the like as a toner constituent component, if desired, and the dispersion is subjected to slow coagulation, which is carded out while balancing the repulsive force of particle surfaces by adjusting a pH and coagulating force generated via addition of coagulants composed of electrolytes, wherein association is carried out while controlling the average particle diameter and the particle size distribution, and at the same time heating and stirring is carried out to cause fusion among particles and control the particle shape. Thus, clear toner particles are prepared in the above-described method.

When the emulsion polymerization coagulation method is employed as a method to produce clear toner, the resulting particles may be comprised of at least two layers containing resins differing in composition. In such a case, it is possible to employ a method in which polymerization initiators and polymerizable monomers are added to the first resin particle dispersion prepared by an emulsion polymerization treatment (the first stage polymerization) based on an ordinary method, and the resulting mixture is subjected to an additional polymerization treatment (the second stage polymerization).

Clear toner is usable as it is, in an image forming method of the present invention, but in order to improve fluidity, electrification, a cleaning property and so forth, the clear toner of the present invention may be obtained by adding external additives such as a fluidizing agent, a cleaning aid or the like as a post-processing agent into the clear toner particle.

As the post-processing agents, there are mentioned inorganic oxide particles such as silica particles, alumina particles and titanium oxide particles; inorganic stearic acid compound particles such as aluminum stearate particles and zinc stearate particles; and inorganic titanic acid compound particles such as strontium titanate particles and zinc titanate pal tides. These may be used singly or in combination with at least two kinds thereof. These inorganic particles are preferably surface treated with a silane coupling agent, a titanium coupling agent, a higher fatty acid or silicone oil in order to improve environmental stability or heat-resistant storage stability.

The clear toner used in an image forming method of the present invention is also usable as a magnetic or non-magnetic single component developer, but may also be employed as a double component developer after being mixed with carriers. When the clear toner used in the present invention is employed as a double component developer, magnetic particles are usable as the carrier, which are composed of commonly known materials such as metals, for example, iron, ferrite and magnetite, and an alloy made from the above-described metal and aluminum or lead. Of these, ferrite particles are specifically preferable. Further, employed as a carrier may be a coated carrier prepared by coating the surface of magnetic particles each with a coating agent such as a resin, and a binder type carrier prepared by dispersing magnetic powder in a binder resin. The coating resin constituting the coated carrier is not specifically limited, and examples thereof include olefin resins, styrene resins, styrene-acryl resins, silicone resins, polyesters and fluorine-containing resins. Further, resins each constituting a resin dispersion type carrier are not specifically limited, and the commonly known are specifically usable. Examples thereof include a styrene-acrylic resin, a polyester resin, a fluorine-containing resin and a phenol resin.

When the gloss adjusting toner is toner in the same color as that of an image support, the toner is possible to have the similar structure, except that a colorant in the same color as that of the image support is contained in the above-described clear toner.

[Toner]

The commonly known are usable for the toner utilized in the step of forming a toner-fixed image, provided that it possesses a toner particle containing at least a binder resin. As such a toner, exemplified are a chromatic toner containing a pigment, a dye or the like, for example, a colorless toner containing no colorant and so forth, but the chromatic toner is preferable in view of image visibility.

The binder resin contained in the toner particle is not specifically limited, and commonly known resins are usable. In cases where the toner is prepared by a pulverizing method, an emulsion dispersion method or the lice, usable examples thereof include vinyl resins such as a styrene resin, a (meth) acryl resin, a styrene-(meth)acrylic copolymer resin, a polyolefin resin and so forth; a polyester resin; a polyamide resin; a polycarbonate resin; a polyether resin; a polyvinyl acetate resin; a polysulfone resin; an epoxy resin; a polyurethane resin; a urea resin; and so forth. These are usable singly, or in combination with at least two kinds thereof. When the toner is prepared by a suspension polymerization method, a dispersion polymerization, an emulsion polymerization method, an emulsion polymerization coagulation method or the like, commonly known various polymerizable monomers are usable as the polymerizable monomers to obtain binder resins constituting toner particles. As the polymerizable monomer, for example, vinyl based monomers are exemplified, and are preferably used in combination with one having an ionic dissociation group. Further, when a polyfunctional vinyl based monomer is used as a polymerizable monomer, a binder resin having a crosslinking structure is also obtainable.

The colorant contained in a toner particle is not specifically limited, and commonly known dyes and pigments are usable. As black colorants, for example, carbon black such as furnace black, channel black, acetylene black, thermal black or lampblack, and also magnetic powder of magnetite or ferrite are exemplified. Further, examples of colorants for magenta or red include C. I. Pigment Red 2, C. I. Pigment Red 3, C. I. Pigment Red 5, C. I. Pigment Red 6, C. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222, and so forth. Further, examples of colorants for orange or yellow include C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 74, C. I. Pigment Yellow 93, C. I. Pigment Yellow 94, C. I. Pigment Yellow 138, and so forth. Further, examples of colorants for green or cyan include C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Blue 62, C. I. Pigment Blue 66, C. I. Pigment Green 7, and so forth.

The colorant in toner has a content of 1-10 parts by weight, with respect to 100 parts by weight of binder resin.

The toner particle may contain a releasing gent, a charge control agent and so forth, if desired.

As a releasing agent, commonly known wax is usable. Examples of the wax include polyolefin wax such as polyethylene wax, polypropylene wax and so forth; branched-chain hydrocarbon wax such as microcrystalline wax and so forth; long chain hydrocarbon wax such as paraffin wax, sazol wax and so forth; dialkyl ketone based wax such as distearyl ketone and so forth; ester based wax such as carnauba wax, montan wax, behenyl behenate, trimethylol propane tribehenate, pentaerithritol tetrabehenate, pentaerithritol diacetate dibehenate, glycerine tribehenate, 1,18-octadecane diol distearate, tristearyl trimellitate, distearyl maleate and so forth; and amide based wax such as ethylene diamine behenylamide, tristearylamide trimellitate and so forth.

The releasing agent in the toner has a content of 20% by weight or less, based on 100% by weight of a binder resin.

A charge control agent is not specifically limited as long as it is a material capable of providing positive or negative charge via frictional electrification, and commonly known various positive charge control agents and negative charge control agents are usable.

The toner preferably has a softening point temperature of 80-140° C., and more preferably has a softening point temperature of 90-120° C.

The softening point of toner is determined as described below. A measuring sample (toner) of 1.1 g is first placed in a Petri dish at a temperature of 20° C. and at a relative humidity of 50%, flattened out, and allowed to stand for at least 12 hours. Thereafter, a 1 cm diameter cylindrical molded sample is prepared via application of a pressure of 3,820 kg/cm$^2$, employing a molding machine "SSP-10A" (produced by Shimadzu Corp.). Subsequently, the resulting sample was measured under a temperature of 24° C. and a relative humidity of 50%, employing a flow tester "CFT-500D" (produced by Shimadzu Corp.). The resulting sample is extruded from a cylindrical die hole (1 mm diameter×1 mm) employing a 1 cm diameter piston after 300 second pre-healing under conditions of an applied load of 196 N (20 kgf), an initial temperature of 60° C., and a temperature raising rate of 6° C./minute, and offset method temperature $T_{offset}$ which is determined based on the fusion temperature determination method according to the temperature raising method, which is set at an offset value of 5 mm, is designated as the softening point of the toner.

Toner preferably has a glass transition point Tg of 20-70° C. in view of fixability of glass adjusting layer 3A and reproducibility of dots.

Glass transition point Tg of toner is measured with "Diamond DSC" manufactured by Perkin-Elmer Corp. In the measuring procedure, 3.0 mg of a measuring sample (toner) is enclosed aluminum pan, and then set onto a sample holder in a main body. Measurements for reference were performed employing an empty aluminum pan. Temperature control of Heat-Cool-Heat is carried out under the conditions of a measurement temperature of 0-200° C., a temperature-increasing speed of 10° C./min and a temperature-decreasing speed of 10° C./min, and analysis is made based on the data of the 2nd Heat. In addition, temperature was maintained at 200° C. for 5 minutes during temperature-increase of the first Heat. Glass transition point Tg is designated as the temperature at an intersection point of an extension line of a base line before rising of the first endoergic peak and the tangential line shown at the maximum inclination in the range between the rising part of the first endoergic peak and the peak thereof.

Toner particles each constituting the toner preferably have a particle diameter of 3-10 μm in terms of a volume-based median diameter, and more preferably have a particle diameter of 5-8 μm in terms of a volume-based median diameter.

The volume-based median diameter of the toner particles is measured and calculated by using "Coulter Counter Multisizer 3" manufactured by Beckman Coulter Co., Ltd. and a computer system fitted with a software for data processing "Software V3.51", manufactured by Beckman Coulter Co., Ltd. As measuring procedures, 0.02 g of a measuring sample (toner) are wetted in 20 ml of a surfactant solution for dispersing the toner (for the purpose of dispersing the toner, for example, a surfactant solution prepared by diluting a neutral detergent with pure water by 10 times), and subsequently subjected to ultrasonic dispersion for one minute to prepare a measuring sample dispersion. The measuring sample dispersion is injected into a beaker set on a sample stand, in which Isoton II, manufactured by Beckman Coulter Co., Ltd., is contained, until the concentration indicated by the measuring device reaches 5-10%. Measured values in high reproducibility can be obtained by falling within this concentration range. The frequency is calculated by separating the range of 2.0-60 μm into 256 divisions under the conditions of the count number of measuring particles of 25,000 and an aperture diameter of 100 μm with the measuring device, and the particle diameter at a point of 50% from the larger side of the volume accumulation ratio is specified as the volume-based median diameter.

Toner particles constituting the toner preferably have an average circularity of 0.850-1.000, and more preferably have an average circularity of 0.900-0.995.

The average circularity of gloss adjusting toner particles is measured by "FPIA-2100" (manufactured by Sysmex Corp.). Specifically, a measuring sample (gloss adjusting toner) is wetted with an aqueous solution containing a surfactant, followed by conducting an ultrasonic dispersion treatment for one minute, and thereafter the dispersion of toner particles is photographed with "FPIA-2100" (manufactured by Sysmex Corp.) in an HPF (high magnification photographing) mode at an appropriate density of the HPF detection number of 3,000-10,000 as a measurement condition. The circularity of each toner particle is calculated in accordance with Equation (T) described below. Then, the average circularity is calculated by summing the circularities of each of particles and dividing the resulting value by the total number of particles.

Circularity=(circumference length of a circle having an area equivalent to a projection of a particle)/(circumference length of a projection of a particle) Equation (T):

As methods of manufacturing the clear toner, provided are a kneading-pulverizing method, a suspension polymerization method, an emulsion polymerization method, an emulsion polymerization coagulation method, a mini-emulsion polymerization coagulation method, and an encapsulation method, and commonly known other methods.

The toner is usable as it is, in an image forming method of the present invention, but in order to improve fluidity, electrification, a cleaning property and so forth, external additives such as a fluidizing agent, a cleaning aid or the like as a post-processing agent may be added into the toner particle.

As the post-processing agents, there are mentioned inorganic oxide particles such as silica particles, alumina particles and titanium oxide particles; inorganic stearic acid compound particles such as aluminum stearate particles and zinc stearate particles; and inorganic titanic acid compound particles such as strontium titanate particles and zinc titanate particles. These may be used singly or in combination with at least two kinds thereof. These inorganic particles are preferably surface treated with a silane coupling agent, a titanium coupling agent, a higher fatty acid or silicone oil in order to improve environmental stability or heat-resistant storage stability.

These various external additives have a total additive amount of 0.05-5 parts by weight, based on 100 parts by weight of the toner, and preferably have a total additive amount of 0.1-3 parts by weight, based on 100 parts by weight of the toner The toner used in an image forming method of the present invention is also usable as a magnetic or non-magnetic single component developer, but may also be employed as a double component developer after being mixed with earners. When the toner used in the present invention is employed as a double component developer, magnetic particles are usable as the carrier, which are composed of commonly known materials such as metals, for example, iron, ferrite and magnetite, and an alloy made from the above-described metal and aluminum or lead. Of these, ferrite particles are specifically preferable. Further, employed as a carrier may be a coated carrier prepared by coating the surface of magnetic particles each with a coating agent such as a resin, and a binder type carrier prepared by dispersing magnetic powder in a binder resin. The coating resin constituting the coated carrier is not specifically limited, and examples thereof include olefin resins, styrene resins, styrene-acryl resins, silicone resins, polyesters and fluorine-containing resins. Further, resins each constituting a resin dispersion type carrier are not specifically limited, and the commonly known are specifically usable. Examples thereof include a styrene-acrylic resin, a polyester resin, a fluorine-containing resin and a phenol resin.

The carrier preferably has a particle diameter of 20-100 μm in terms of a volume-based median diameter, and more preferably has a particle diameter of 20-60 μm in terms of a volume-based median diameter. The volume-based median diameter of the carrier is determined, employing a laser diffraction type particle size distribution meter "HELOS" (manufactured by SYMPATEC Co.) equipped with a wet dispersing device as a typical meter.

As the image support used in the image forming method of the present invention, provided can be various kinds of the image support, for example, plain paper from thin paper to heavy paper; fine-quality paper; coated paper for printing such as art paper or coated paper; commercially available Japanese paper and post-card paper; OHP plastic film; and fabric, but the present invention is not limited thereto.

In an image forming method of the present invention, gloss adjusting layer 3A for gloss adjusting toner-fixed image 3 formed on image support 10 is formed from an aggregate of gloss adjusting units. When a gloss adjusting unit comprises a gloss adjusting toner-attached section and a gloss adjusting toner-unattached section, and a borderline between the gloss adjusting toner-attached section and the gloss adjusting toner-unattached section is a straight line, an image in which an arbitrary section is adjusted to any glossiness can be formed by using those in selected kind and size as gloss adjusting units.

[Image Forming Apparatus]

An image forming apparatus of the present invention possesses a device of forming a gloss adjusting toner image by which an electrostatic latent image formed on an electrostatic latent image carrier is developed with a developer in which a gloss adjusting toner is contained to form the gloss adjusting toner image, and a device of forming a gloss adjusting toner-fixed image by which the gloss adjusting toner-fixed image is transferred onto an image support, and fixed to form the gloss adjusting toner-fixed image, wherein the gloss adjusting toner-fixed image formed by the device of forming the gloss adjusting toner-fixed image comprises a gloss adjusting layer formed from an aggregate of gloss adjusting units; the gloss adjusting units each comprise a gloss adjusting toner-attached section and a gloss adjusting toner-unattached section; and a borderline between the gloss adjusting toner-attached section and the gloss adjusting toner-unattached section is a straight line. Further, such an image forming apparatus preferably possesses a device of forming a toner image by which an electrostatic latent image formed on an electrostatic latent image carrier is developed with a developer in which a toner is contained, and a device of forming a toner-fixed image by which the toner image is transferred onto the gloss adjusting toner-fixed image, and fixed to form the toner-fixed image. That is to say, the image forming apparatus of the present invention preferably has a structure in which a device of forming a gloss adjusting toner-fixed image to conduct a step of forming a gloss adjusting layer, and a device of forming a toner-fixed image to conduct a step of forming the toner-fixed image are continuously operated.

Figure 4:
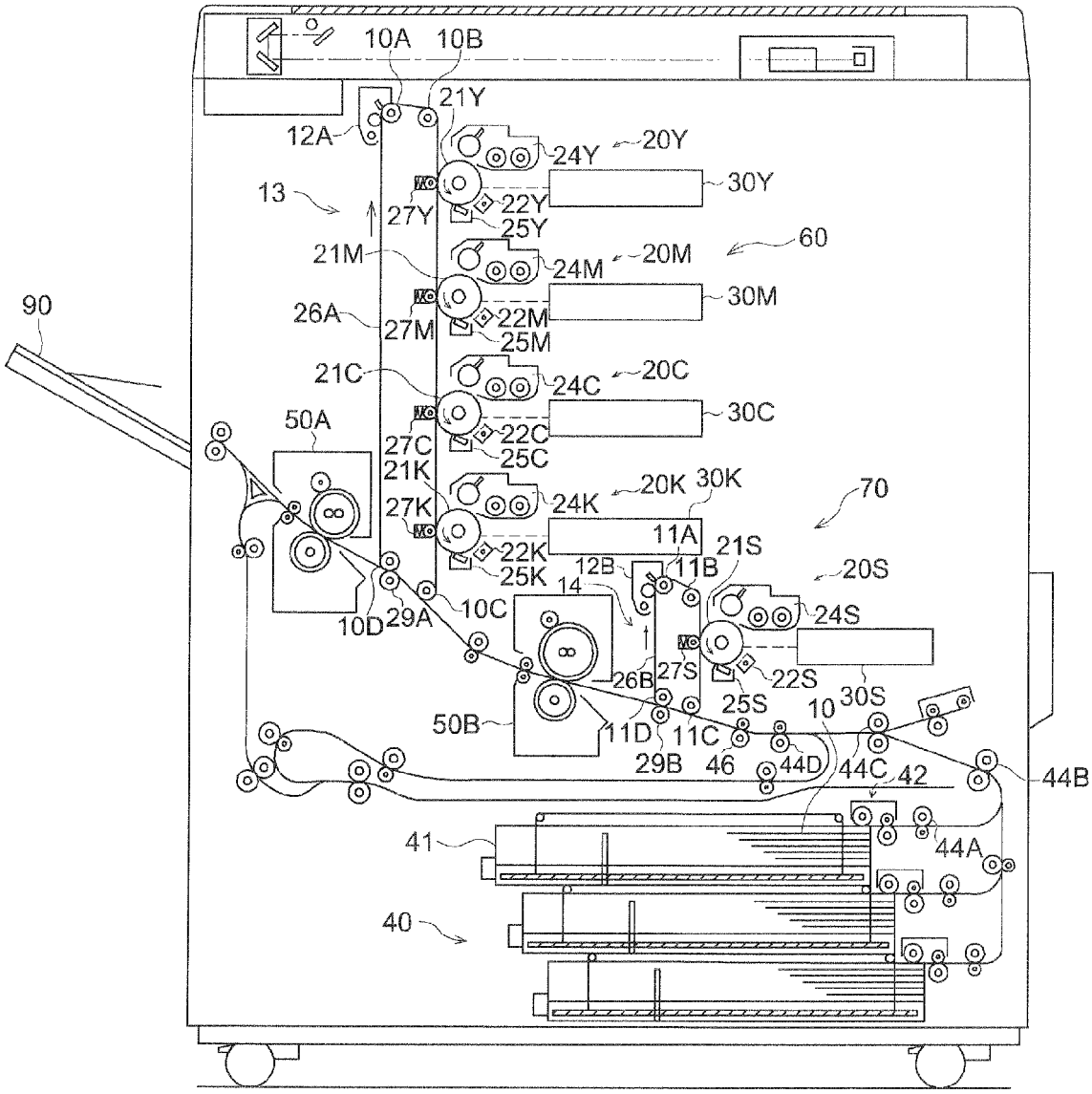
FIG. 4 is a schematic diagram showing an example of configuration of an image forming apparatus of the present invention.

FIG. 4 is a schematic diagram showing an example of configuration of an image forming apparatus of the present invention. The image forming apparatus is a tandem type color image forming apparatus by which a step of forming a gloss adjusting layer with a clear toner and a step of forming a toner-fixed image with a chromatic toner are continuously operated in an image forming method of the present invention.

The image forming apparatus possesses chromatic toner-fixed image forming section 60 equipped with a plurality of chromatic toner image forming sections 20Y, 20M, 20C and 20K, chromatic toner intermediate transfer unit 13 and fixing device 50A; gloss adjusting toner-fixed image forming section 70 equipped with gloss adjusting toner image forming section 20S, gloss adjusting toner intermediate transfer unit 14 and fixing device 50B; and sheet-feeding device 40.

In gloss adjusting toner image forming section 20S of gloss adjusting toner-fixed image forming section 70, a gloss adjusting toner image to form a gloss adjusting layer is formed, but in the case of an example of the image forming apparatus, a clear toner image is formed. Further, in chromatic toner-fixed image forming section 60, yellow toner images are formed in yellow toner image forming section 20Y; magenta toner images are formed in magenta toner image forming section 20M; cyan toner images are formed in cyan toner image forming section 20C; and black toner images are formed in black toner image forming section 20K.

In FIG. 4, 21S represents a photoreceptor as an electrostatic latent image carrier, 22S represents a charging device by which uniform potential is applied to the surface of photoreceptor 21S; 30S represents a light exposure device by which light exposure is conducted based on data of an aggregate of gloss adjusting units in kind, size and a placing method selected in accordance with glossiness designed to be set on evenly charged photoreceptor 21S to form an electrostatic latent image; 24S represents a developing device by which the electrostatic latent image is visualized after transferring toner onto photoreceptor 21S; 27S represents a primary transfer roller as a primary transfer device; 26B represents an intermediate transfer member; 29B represents a secondary transfer roller as a secondary transfer device by which a gloss adjusting toner image having been transferred onto intermediate transfer member 26B with primary transfer roller 27S is transferred onto image support 10; and 25S represents a cleaning device by which residual toner remaining on photoreceptor 21S is collected after primarily transferring.

Further, each of 21Y, 21M, 21C and 21K represents a photoreceptor as an electrostatic latent image carrier; each of 22Y, 22M, 22C and 22K represents a charging device by which uniform potential is applied to the surface of each of photoreceptors 21Y, 21M, 21C and 21K; each of 30Y, 30M, 30C and 30K represents a light exposure device by which light exposure is conducted on each of evenly charged photoreceptors 21Y, 21M, 21C and 21K in accordance with image data to form an electrostatic latent image; each of 24Y, 24M, 24C and 24K represents a developing device by which the electrostatic latent image is visualized after transferring chromatic toner onto each of photoreceptors 21Y, 21M, 21C and 21K; each of 27Y, 27M, 27C and 27K represents a primary transfer roller as a primary transfer device; 26A represents an intermediate transfer member, 29A represents a secondary transfer roller as a secondary transfer device by which a chromatic toner image having been transferred onto intermediate transfer member 26A by each of primary transfer rollers 27Y, 27M, 27C and 27K is transferred onto a gloss adjusting toner-fixed image formed in gloss adjusting toner-fixed image forming section 70; and each of 25Y, 25M, 25C and 25K represents a cleaning device by which residual toner remaining on each of photoreceptors 21Y, 21M, 21C and 21K is collected after primarily transferring.

Gloss adjusting toner intermediate transfer unit 14 in gloss adjusting toner-fixed image forming section 70 is windingly wound with a plurality of rollers 11A, 11B, 11C and 11D, and is equipped with rotatably supported endless belt-shaped intermediate transfer member 26B, primary transfer roller 27S and cleaning device 12B. Similarly, chromatic toner intermediate transfer unit 13 in chromatic toner-fixed image section 60 is windingly wound with a plurality of rollers 10A, 10B, 10C and 10D, and is equipped with rotatably supported endless belt-shaped intermediate transfer member 26A, primary transfer rollers 27Y, 27M, 27C and 27K, and cleaning device 12A.

As to such an image forming apparatus, a gloss adjusting toner image is formed on photoreceptor 21S via electrification with charging device 22S, light exposure with light exposure device 30S and development with developing device 24S in gloss adjusting toner image forming section 20S in gloss adjusting toner-fixed image forming section 70, and a gloss adjusting toner image is transferred onto intermediate transfer member 26B with primary transfer roller 27S. Then, a gloss adjusting toner image having been transferred onto image support 10 is fixed via application of pressure while heating to form gloss adjusting toner-fixed image 3. Then, image support 10 stored in sheet-feeding cassette 41 is fed by sheet-feeding device 42 and conveyed to secondary transfer roller 29B via a plurality of sheet-feeding rollers 44A, 44B, 44C and 44D, and registration roller 46, and a gloss adjusting toner image transferred onto intermediate transfer member 26A is transferred onto image support 10. Then, a gloss adjusting toner image having been transferred onto image support 10 is fixed by fixing device 50B via applied pressure and heating to form gloss adjusting toner-fixed image 3.

Subsequently, a chromatic image for each color is formed on each of photoreceptors 21Y, 21M, 21C and 21K via electrification with each of charging devices 22Y, 22M, 22C and 22K; light exposure with each of light exposure devices 30Y, 30M, 30C and 30K; and development with each of developing devices 24Y, 24M, 24C and 24K in each of chromatic toner image forming sections 20Y, 20M, 20C and 20K in chromatic toner-fixed image forming section 60, and toner images for each color are sequentially superimposed on intermediate transfer member 26A with each of primary transfer rollers 27Y, 27M, 27C and 27K. Then, chromatic toner images having been transferred onto intermediate transfer member 26A are transferred all at once onto the gloss adjusting toner-fixed image of secondary transfer roller 29A in gloss adjusting toner-fixed image forming section 70. Then, the chromatic toner image having been transferred onto the gloss adjusting toner-fixed image is fixed via application of pressure while heating, employing fixing device 50A to form chromatic toner-fixed image 2. Subsequently, image support 10 having formed chromatic toner-fixed image 2 on the gloss adjusting toner-fixed image is placed on paper-ejection tray 90 provided outside the machine.

Photoreceptors 21Y, 21M, 21C and 21K after transferring the chromatic toner image onto intermediate transfer member 26A are subjected to the subsequent image formation after cleaning toner remaining on each of the photoreceptors during transfer, employing each of cleaning devices 25Y, 25M, 25C and 25K. Further, photoreceptor 21S after transferring a gloss adjusting toner image onto intermediate transfer member 26B is subjected to the subsequent image formation after cleaning toner remaining on the photoreceptor during transfer, employing cleaning device 25S. On the other hand, in the case of intermediate transfer member 26A after transferring the chromatic toner image onto image support 10 with cleaning device 25S, residual toner is removed therefrom by cleaning device 12A. Further, in the case of intermediate transfer member 26B after transferring the glass adjusting toner image onto the chromatic toner-fixed image with secondary transfer roller 29B, residual toner is removed therefrom by cleaning device 12B.

In the case of an image forming apparatus of the present invention, an image forming method of the present invention is carried out, whereby an image in which arbitrary section is adjusted to any glossiness can be formed.

EXAMPLE

Next, specific examples of the present invention will be described, but the present invention is not limited thereto.

[Preparation Example 1 of Resin Particles]

(1) The First Stage Polymerization

A surfactant solution obtained by dissolving 4 g of polyoxyethylene-2-dodecyl ether sodium sulfate in 3000 g of deionized water was charged in a 5 liter reaction vessel fitted with a stirrer, a temperature sensor, a cooling tube and a nitrogen gas-introducing device, and internal temperature was raised to 80° C. white stirring at a stirring speed of 230 rpm under nitrogen flow. After an initiator solution in which 5 g of a polymerization initiator (potassium persulfate: KPS) were dissolved in 200 g of deionized water was added into the above-described surfactant solution, and the liquid temperature was set to 75° C., a monomer mixture solution containing 567 g of styrene, 165 g of n-butylacrylate and 68 g of methacrylic acid was dripped for one hour, and the system was heated at 75° C. while stirring for 2 hours to conduct polymerization (the first stage polymerization) reaction, whereby dispersion <A1> in which resin particle [A1] was dispersed was obtained.

(2) The Second Stage Polymerization

A surfactant solution obtained by dissolving 2 g of polyoxyethylene-2-dodecyl ether sodium sulfate in 1270 g of deionized water was charged in a 6 liter reaction vessel fitted with a stirrer, a temperature sensor, a cooling tube and a nitrogen gas-introducing device, and internal temperature was raised to 80° C. Subsequently, 40 g of the above-described dispersion <A1> in solid content conversion were charged, and a monomer solution in which a monomer mixture solution containing 123 g of styrene, 45 g of n-butylacrylate, 20 g of methacrylic acid, 0.5 g of n-octylmercaptan and 82 g of paraffin wax (HNP-57, produced by Nippon Seiro Co., Ltd.) were dissolved at 80° C. was further added threrein, and mixed and dispersed by a mechanical homogenizer (CLEARMIX, manufactured by M•Technique Co., Ltd.) having a circulation route for one hour to prepare a dispersion containing emulsified particles. Next, an initiator solution in which 5 g of potassium persulfate were dissolved in 100 g of deionized water was added into the above-described dispersion, and this system was heated at 80° C. for one hour to conduct polymerization (the second stage polymerization) reaction, whereby a dispersion <A2> in which resin particle [A2] was dispersed was obtained.

(3) The Third Stage Polymerization

An initiator solution in which 10 g of potassium persulfate were dissolved in 200 g of deionized water was added into the above-described dispersion <A2>, and a monomer mixture solution containing 390 g of styrene, 143 g of n-butylacrylate, 37 g of methacrylic acid and 13 g of n-octylmercaptan was dripped at a temperature of 80° C. for one hour. After dripping was completed, the system was stirred while healing for 2 hours to conduct polymerization (the third polymerization). Subsequently, the system was cooled to 28° C. to obtain resin particle dispersion <1> in which resin particle [1] composed of composite resin particles was dispersed. Resin particle [1] had a glass transition point of 49° C.

[Preparation Example of Clear Toner 1]

After a surfactant solution obtained by dissolving 450 g of resin particle dispersion <1> in solid content conversion and 2 g of polyoxyethylene-2-dodecyl ether sodium sulfate in 1100 g of deionized water was charged in a 5 liter reaction vessel fitted with a stirrer, a temperature sensor, a cooling tube and a nitrogen gas-introducing device, and liquid temperature was adjusted to 30° C., 5N of sodium hydroxide were added into this solution to adjust pH to 10. Next, an aqueous solution obtained by dissolving 60 g of magnesium chloride hexahydrate in 60 g of deionized water was added at 30° C. spending 10 minutes while stirring, and after standing for 3 minutes, temperature started to be raised. Temperature of this system was increased to 85° C. spending 60 minutes; particle growth reaction was continued in a state where temperature was maintained at 85° C.; and particle diameters of associated particles were measured in this state, employing "Coulter Counter Multisizer 3" manufactured by Beckman Coulter Co., Ltd. When a volume-based medium diameter reached 7.4 μm, an aqueous solution obtained by dissolving 200 g of sodium chloride in 860 g of deionized water was added therein to terminate the particle growth. Further, after fusing was conducted by heating the system while stirring at a liquid temperature of 95° C. for a ripening treatment, and this process was continued until circularity reached 0.90, the liquid temperature was cooled to 30° C. Then, solid liquid separation was made employing a basket type centrifugal separator (MARK III type No. 60×40, produced by Matsumoto Kikai Co. Ltd.) to form a wet cake of toner mother particles, and the wet cake was repeatedly washed with 40° C. deionized water in the basket type centrifugal separator until the filtrate reached an electrical conductivity of 5 μS/cm; subsequently transferred to "Flash Jet Dryer, produced by Seishin Enterprise Co., Ltd."; and dried until a moisture content reached 0.5% by weight to obtain clear toner particle [1]. Then, 1% by weight of hydrophobic silica (a number average primary particle diameter of 12 nm) and 0.3% by weight of hydrophobic titanium oxide (a number average primary particle diameter of 20 nm) were added into clear toner particle [1], and mixed employing "Henschel mixer" (manufactured by Mitsui Mining Co., Ltd.) to prepare clear toner (1). Clear toner (1) has a softening point of 133° C., a glass transition point of 49° C., a volume-based median diameter of 5.3 μm, and an average circularity of 0.910.

[Preparation Example of Each of Clear Toners (2)-(5)]

Clear toners (2)-(5) having volume-based median diameters of 7.2 μm, 14.8 μm, 3.3 μm and 20.2 μm, respectively, were prepared similarly to the preparation example of clear toner (1), except that timing of adding sodium chloride into associated particles was changed. In addition, any of the clear toners has a softening point of 133° C., a glass transition point of 49° C., and an average circularity of 0.910.

Example 1

Step of Forming Gloss Adjusting Layer

Clear toner (1) was applied to an image forming apparatus "bizhub C353", manufactured by Konica Minolta Business Technologies, Inc.; a very fine gloss adjusting unit, 100 μm as "a" on a side as shown in FIG. 2*a* was used; and a gloss adjusting layer comprising a gloss adjusting toner-fixed image in which the gloss adjusting units were densely placed longitudinally and transversely on a plane of an image support was formed on the image support "OK TOPKOTE+157 $\mu m^2$", produced by Oji Paper Co., Ltd.

(Step of Forming Toner-Fixed Image)

Thereafter, chromatic toner (cyan toner and black toner) used for commercially available "bizhub C353" is applied to a new image forming apparatus "bizhub C353", manufactured by Konica Minolta Business Technologies, Inc., and a toner-fixed image composed of three solid black patch images (20 mm×50 mm in each size) and three solid cyan patch images (20 mm×50 mm in each size) is formed on a gloss adjusting layer provided on an image support to obtain a gloss adjusting image. With respect to the gloss adjusting unit, "a" on a side, when "a" is 200 μm, 300 μm, 400 μm or 500 μm, a gloss adjusting layer in each of the foregoing cases is similarly formed, and the following evaluations have been made.

Examples 2-7

The gloss adjusting layers were formed to make the following evaluations, similarly to Example 1, except that the kind of each clear toner as well as each gloss adjusting unit was changed as described in Table 1. In addition, as to a gloss adjusting unit shown in FIG. 2*b*, which is used in Example 4, a square having a one-half of a side of the gloss adjusting unit in length, which is located in the center of the gloss adjusting unit, is formed and constituted as a clear toner-unattached section.

Comparative Example 1

The gloss adjusting layers were formed to make the following evaluations, similarly to Example 1, except that the kind of clear toner as well as a gloss adjusting unit was changed as described in Table 1, and the step of forming a gloss adjusting layer and the step of forming a toner-fixed image were carried out in reverse order.

Comparative Example 2

A glass adjusting layer was formed similarly to Example 2, except that the gloss adjusting unit shown in FIG. 2*d* was used. The following evaluations were made for the resulting glass adjusting image.

[Evaluation 1: Controllability of Glossiness]

Glossiness of "gloss adjusting image was measured in accordance with "JIS Z8741". In addition, the glossiness is measured at an incident angle of 75°, employing "GARDENER MICROGLOSS 75°", manufactured by Toyo Seiki Seisakusho, Ltd. The mean glossiness values of the total 6 portions including the portion with respect to glossiness on each of 3 solid black patch images, and the other portion with respect to glossiness on each of 3 solid cyan patch images in the resulting gloss adjusting image are shown in Table 1.

[Evaluation 2: Unpleasant Sensation]

With respect to the gloss adjusting image, presence or absence of unpleasant sensation was determined by 20 examinees. When the number of examinees feeling no unpleasant sensation is 15 or more, "pass" is given to this evaluation, and when the number of examinees feeling no unpleasant sensation is less than 15, "fail" is given to this evaluation.

TABLE 1

| | Clear toner No. | Particle diameter of clear toner (μm) | Gloss adjusting unit Kind | Step sequence | Glossiness when a gloss adjusting unit has each of 100 μm, 200 μm, 300 μm, 400 μm and 500 μm on a side | | | | | Un-pleasant sensation | Thickness of gloss adjusting layer (μm) |
|---|---|---|---|---|---|---|---|---|---|---|---|
| | | | | | 100 (μm) | 200 (μm) | 300 (μm) | 400 (μm) | 500 (μm) | | |
| Ex. 1 | [1] | 5.3 | FIG. 2a | *1 | 45 | 54 | 68 | 75 | 79 | Pass | 4 |
| Ex. 2 | [2] | 7.2 | FIG. 2a | *1 | 48 | 58 | 69 | 74 | 80 | Pass | 5 |
| Ex. 3 | [3] | 14.8 | FIG. 2a | *1 | 43 | 52 | 64 | 70 | 75 | Pass | 12 |
| Ex. 4 | [2] | 7.2 | FIG. 2b | *1 | 57 | 67 | 71 | 75 | 81 | Pass | 5 |
| Ex. 5 | [2] | 7.2 | FIG. 2c | *1 | 58 | 60 | 70 | 74 | 80 | Pass | 5 |
| Ex. 6 | [4] | 3.3 | FIG. 2a | *1 | 67 | 69 | 73 | 75 | 78 | Pass | 2 |
| Ex. 7 | [5] | 20.2 | FIG. 2a | *1 | 39 | 42 | 43 | 55 | 58 | Pass | 15 |
| Comp. 1 | [2] | 7.2 | FIG. 2a | *2 | 39 | 42 | 43 | 55 | 58 | Fail | 5 |
| Comp. 2 | [2] | 7.2 | FIG. 2d | *1 | 46 | 47 | 49 | 51 | 52 | Pass | 5 |

Ex.: Example
Comp.: Comparative example
*1: Step of forming gloss adjusting layer → Step of forming toner-fixed image
*2: Step of forming toner-fixed image → Step of forming gloss adjusting layer As is clear from the above-described results of Examples 1-7 in the present invention, it was confirmed that glossiness was adjusted and gloss adjusting images each exhibiting no unpleasant sensation were obtained by appropriately using the gloss adjusting unit in selected kind and size. In addition, as to gloss adjusting layers each having a layer thickness of 5 μm in Examples of Table 1, it is confirmed that each glossiness of Comparative example 2 when using a gloss adjusting unit shown in FIG. 2*d* is smaller than when using each of gloss adjusting units shown in FIGS. 2*a*-2*c*.

EFFECT OF THE INVENTION

According to an image forming method of the present invention, when a gloss adjusting layer comprising a gloss adjusting toner-fixed image, on an image support is formed from an aggregate of gloss adjusting units; the gloss adjusting units each comprise a section to which gloss adjusting toner adheres (hereinafter, referred to also as "a section where a gloss adjusting toner is attached"), and another section to which no gloss adjusting toner adheres (hereinafter, referred to also as "another section where a gloss adjusting toner is unattached"); and a borderline between the section and the another section is a straight line, an image in which an arbitrary section is adjusted to any glossiness can be formed by using the gloss adjusting unit in selected kind and size.

As to an image forming apparatus of the present invention, since an image forming method of the present invention is implemented, an image in which an arbitrary section is adjusted to any glossiness can be formed.

What is claimed is:

1. A method for forming an image comprising the steps of:

(a) forming a gloss adjusting layer comprising a gloss adjusting toner-fixed image formed with a gloss adjusting toner, on an image support, and (b) forming a toner-fixed image obtained from a toner, on the gloss adjusting layer, wherein the gloss adjusting layer comprises an aggregate of gloss adjusting units;

each of the gloss adjusting units comprises a section where the gloss adjusting toner is attached and another section where the gloss adjusting toner is unattached;

a borderline between the section and the another section comprises a straight line; each of the gloss adjusting units is in the form of a square having a side length of 100-500 μm, each square of the gloss adjusting units is divided longitudinally and transversely in two equal parts to form four squares, in which two of the four squares are gloss adjusting toner-attached sections, and one of the two gloss adjusting toner-attached sections is not placed longitudinally or transversely with respect to another of the two gloss adjusting toner-attached sections, and the step (a) further comprises a step of adjusting a glossiness of the image by varying the side length of the each of the gloss adjusting units in the gloss adjusting layer.

2. The method of claim 1, wherein the gloss adjusting layer comprises a clear toner.

3. The method of claim 1, wherein the gloss adjusting layer has a thickness of 3-20 μm.

4. The method of claim 1, wherein the gloss adjusting toner comprises a particle having a particle diameter of 5-15 μm.

5. The image forming method of claim 1, wherein the longer the side length is, the higher the glossiness is, and the shorter the side length is, the lower the glossiness is of the image.

6. An apparatus for forming an image comprising:

a device for forming a gloss adjusting toner image by which an electrostatic latent image formed on an electrostatic latent image carrier is developed with a developer in which a gloss adjusting toner is contained to form the gloss adjusting toner image, a device for forming a gloss adjusting toner-fixed image by which the gloss adjusting toner image is transferred onto an image support, and fixed to form the gloss adjusting toner-fixed image, a device of forming a toner image by which an electrostatic latent image formed on an electrostatic latent image carrier is developed with a developer in which a toner is contained, and a device of forming a toner-fixed image by which the toner image is transferred onto the gloss adjusting toner-fixed image, and fixed to form the toner-fixed image, wherein a gloss adjusting layer formed from an aggregate of gloss adjusting units comprises the gloss adjusting toner-fixed image formed with the device for forming the gloss adjusting toner-fixed image;

each of the gloss adjusting units comprises a section where the gloss adjusting toner is attached and another section where the gloss adjusting toner is unattached;

a borderline between the section and the another section comprises a straight line;

each of the gloss adjusting units is in the form of a square having a side length of 100-500 μm, each square of the gloss adjusting units is divided longitudinally and transversely in two equal parts to form four squares, in which two of the four squares are gloss adjusting toner-attached sections, and one of the two gloss adjusting toner-attached sections is not placed longitudinally or transversely with respect to another of the two gloss adjusting toner-attached sections, and a glossiness of the image is adjusted by varying the side length of the each of the gloss adjusting units in the gloss adjusting layer.

7. The image forming apparatus of claim 6, wherein the longer the side length is, the higher the glossiness is, and the shorter the side length is, the lower the glossiness is of the image.

* * * * *